United States Patent [19]

Kimura et al.

[11] Patent Number: 4,625,524

[45] Date of Patent: Dec. 2, 1986

[54] AIR-COOLED HEAT PUMP TYPE REFRIGERATING APPARATUS

[75] Inventors: Takashi Kimura; Hiromi Tanaka; Masayoshi Omori, all of Shimizu, Japan

[73] Assignee: Hitachi, Ltd., Tokyo, Japan

[21] Appl. No.: 804,939

[22] Filed: Dec. 5, 1985

[30] Foreign Application Priority Data

Dec. 7, 1984 [JP] Japan ..... 59-257536

[51] Int. Cl.[4] ..... F25B 47/00

[52] U.S. Cl. ..... 62/278; 62/324.1; 62/525

[58] Field of Search ..... 62/278, 81, 525, 324.1; 237/2 B

[56] References Cited

U.S. PATENT DOCUMENTS

| | | | |
|---|---|---|---|
| 4,024,722 | 5/1977 | McCarty | 62/81 |
| 4,313,313 | 2/1982 | Chrostowski et al. | 62/278 |
| 4,565,070 | 1/1986 | Raymond | 62/81 |

*Primary Examiner*—Henry Bennett

*Attorney, Agent, or Firm*—Antonelli, Terry & Wands

[57] ABSTRACT

An improved air-cooled heat pump type refrigerating apparatus having a refrigerant circuit reversible into a heating mode and a cooling mode, comprising a series of elements connected by piping means, which include a compressor, a four-way valve, an indoor heat exchanger, a capillary tube for cooling having first check valve connected in parallel therewith, a capillary tube for heating having second check valve connected in parallel therewith and an outdoor heat exchanger. The circuit, by switching the four-way valve, is capable of providing a heating operating mode, a cooling operation mode or a defrosting operation mode. The apparatus is constructed such that a branch tube branching off from a discharge tube of the compressor is provided and midway thereon with a solenoid valve and has a plurality of capillary tubes connected to the other end the branch tube through a distributor. The capillary tubes are connected respectively to heat transfer tubes of the outdoor heat exchanger at points midway thereon. The solenoid valve is arranged to effect during the heating operation the opening and closing thereof by a control circuit which operates to sense the outdoor air temperature and relative humidity.

5 Claims, 6 Drawing Figures

AIR-COOLED HEAT PUMP TYPE REFRIGERATING APPARATUS

FIELD OF THE INVENTION AND RELATED ART

The present invention relates a heat pump type refrigerating apparatus having a refrigerant circuit comprising a compressor, an indoor heat exchanger, capillary tubes an outdoor heat exchanger and a four-way valve and capable of cooling and heating a room by shifting the four-way valve, and more particularly, to an air cooled heat pump type refrigerating apparatus contemplating a restriction of the frosting during the heating operation thereof on the outdoor heat exchanger and an improvement in the defrosting function during the defrosting operation thereof.

In U.S. Pat. No. 4,024,722, there is proposed a prior art system relating to a defrosting control for an air-cooled heat pump type refrigerating apparatus having a construction similar to that described above, which system, for the purpose of controlling its defrosting operation by sensing frosting conditions, is provided with a sensing element adapted to sense outdoor air temperature and outdoor heat exchanger temperature and another sensing element to sense outdoor air temperature and temperature of suction pipe of the compressor when heating. This prior art system, however, has not been designed with regard to the restricting of the frosting and an improvement in the defrosting capacity under such circumstances as lower outdoor air temperature.

OBJECT AND SUMMARY OF THE INVENTION

An object of the present invention is to provide an air-cooled heat pump type refrigerating apparatus which, during the heating operation, realizes a restriction of the defrosting or a growth of the frost on the outdoor heat exchanger, the prevention of deterioration of the heating capacity, and maintenance of the designed heating efficiency as well as, during the defrosting operation, an improvement in the defrosting efficiency.

To this end, according to the invention, there is provided an air-cooled heat pump type refrigerating apparatus capable of heating and cooling a room having a refrigerant circuit comprising a compressor, a four-way valve, an indoor heat exchanger, capillary tubes, an outdoor heat exchanger a branch tube branching from a discharge tube of the compressor, a solenoid valve provided at the midway of the branch tube, a distributor connected to the other end of the branch tube and a plurality of capillary tubes connected to the distributor, said capillary tubes being connected to heat transfer tubes of the outdoor heat exchanger at the points midway thereon respectively, and said solenoid valve being arranged to effect during the heating operation the opening and closing thereof by means of a control circuit which operates to sense the outdoor air temperature and relative humidity.

According to the above-noted construction, therefore, it is possible that during the heating operation, by continuously sensing the outdoor air temperature and outdoor air relative humidity, the solenoid valve is opened by the control circuit if a sensed and relative humidity are in the frosting temperature zone and cause a part of the discharge gas from the compressor to be injected through the branch tube and capillary tubes into the heat transfer tubes of the outdoor heat exchanger at the points midway thereon to thereby raise the temperature of the outdoor heat exchanger thus enabling a restriction of the frosting as well as an enlargement of the non-frosting outdoor air temperature and humidity zone and, in addition, reducing the frequency of the defrosting operations as the result of the restriction of the frosting, which necessarily leads to an improvement in an integrated heating capacity.

Further, during the defrosting operation, to cooperate with the normal reverse cycle defrosting mode, the opening of the solenoid valve permits a part of the discharge gas to directly enter the more heavily frosted passage portions which are designed to become the upstream side during the heating operation. This contributes much to enhancement of the defrosting capacity and also to the shortening of the defrosting time.

DETAILED DESCRIPTION OF THE PREFERRED EMBODIMENTS

Figure 1:
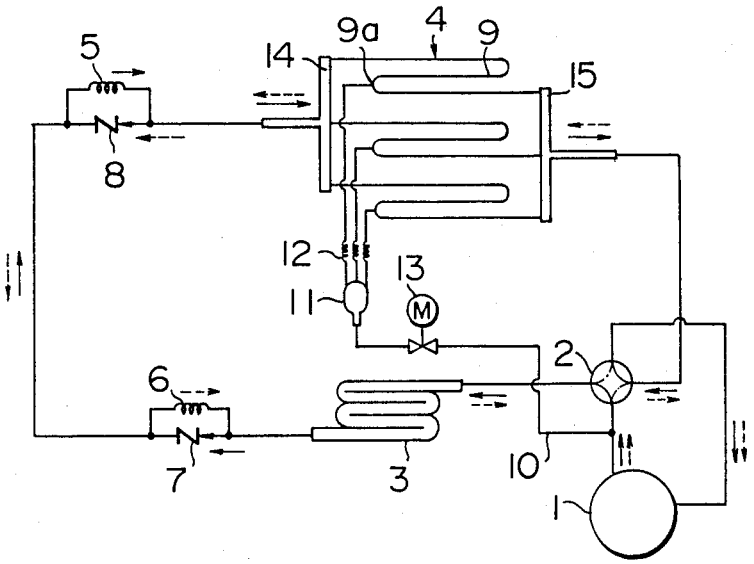
FIG. 1 is a diagram of a refrigerant circuit for an air-cooled heat pump type refrigerating apparatus illustrating an embodiment according to the present invention.

Referring first to FIG. 1, there is shown a refrigerant circuit for an air-cooled heat pump type refrigerating apparatus, comprising a compressor 1, a four-way valve 2, an indoor heat exchanger 3, an outdoor heat exchanger 4, a capillary tube for heating 5, a capillary tube 6 for cooling, first check valve 7, second check valve 8. These components are shown connected each other so as to constitute the refrigerant circuit by the medium of piping means as seen in the drawing wherein the arrow-headed solid lines indicate the flow direction of the refrigerant during the heating operation while arrow-headed dashed lines indicate the flow direction of the refrigerant during the defrosting operation. A branch tube 10 is provided branching off from the compressor 1 at a point on a discharge tube of the compressor. The branch tube 10 has a distributor 11 fixedly secured to the extremity thereof, which distributor 11 is provided with the same number of outlets as the number of heat transfer tubes 9 of the outdoor heat exchanger 4. The respective outlets of the distributor 11 are connected via capillary tubes 12 to the respective heat transfer tubes 9 of the outdoor heat exchanger 4 at the points 9*a* midway thereon.

Figure 2:
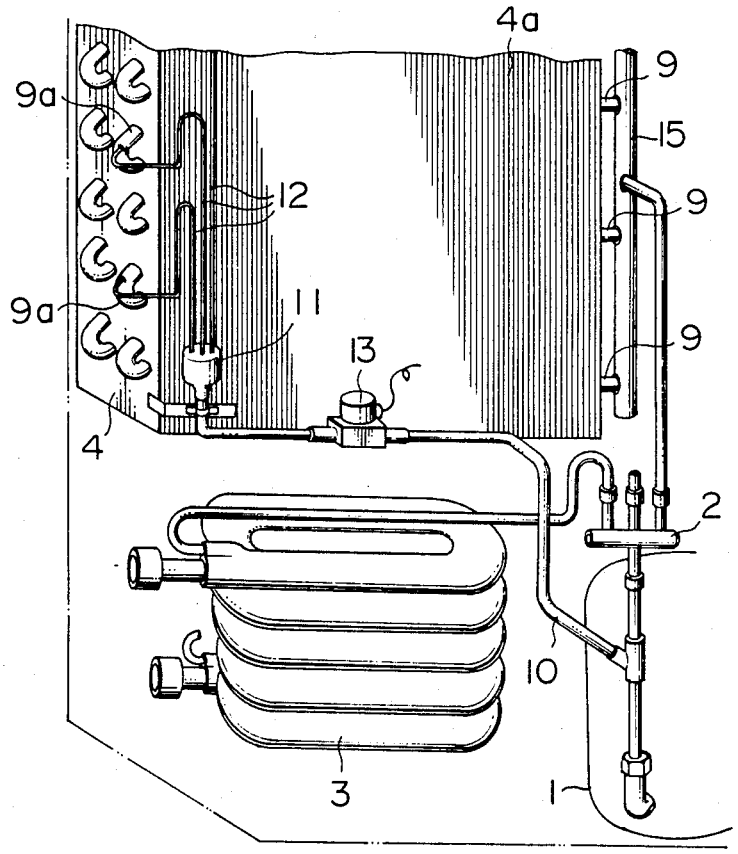
FIG. 2 is a detailed perspective representation of a portion of an outdoor heat exchanger included in the apparatus shown in FIG. 1.

In the preferred embodiment, the indoor heat exchanger 3 is shown as a cold and hot water heat exchanger capable of providing cold water for the cooling and hot water for the heating. As is illustrated particularly in FIG. 2, the outdoor heat exchanger 4 is of a cross fin tube type wherein a plurality of hairpin-shaped heat transfer tubes 9 are arranged penetrating the multiplicity of juxtaposed fins 4*a* and the respective capillary tubes 12 are connected to the outdoor heat exchanger 4 by having each capillary tube 12 sealingly inserted into the U-shaped bend portion 9*a* of each heat transfer tube 9 projecting out of the fin 4*a*. Further, midway on the branch tube 10, is insertedly provided a solenoid valve 13 which is adapted to operate by means of a control circuit as will be seen later. In FIG. 1, reference numerals 14 and 15 respectively indicate headers of the outdoor heat exchanger 4.

Figure 3:
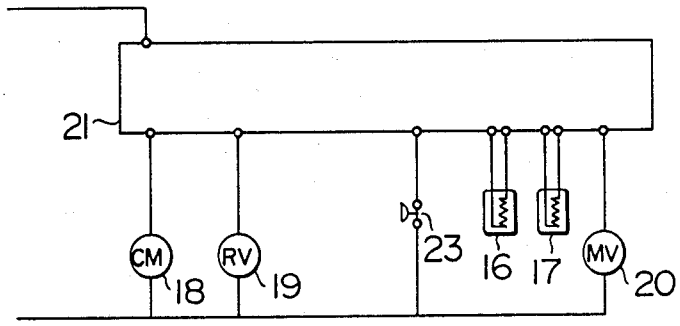
FIG. 3 is a diagram of a control circuit used in the embodiment shown in FIG. 1.

Turning now to FIG. 3, there is shown a control circuit for the preferred embodiment, wherein its temperature sensor circuit is provided with a thermistor 16 for sensing the outdoor temperature and a thermistor 17 for sensing the outdoor air relative humidity, and the arrangements are such that signals of those thermistor resistances undergo comparison and decision at a comparator incorporated in a printed circuit substrate 21 and are subjected to transmission through driver means also incorporated in said substrate 21 and function to control relay means connected to loads. To put it more particularly, at the time of the heating operation and when the temperature of the outdoor heat exchanger 4 is not lower than the set temperature for starting the defrosting operation, the contact of a four-way valve control relay (not shown) in the printed circuit substrate 21 is closed so that a four-way valve coil 19 is in its energized condition and hence the apparatus does not enter its defrosting operation. When the frost deposited on the outdoor heat exchanger 4 has progressively and substantially been increased in depth and area due to continued heating operation and therefore the temperature of the heat exchanger 4 has gone down to the set temperature for starting the defrosting operation, the contact of the four-way valve coil 19 is opened by a signal generated according to the mutual relationship between the temperature and the thermistor resistance value so that the four-way valve coil 19 is deenergized whereby the apparatus is switched to its defrosting operation cycle. At this moment, however, a compressor relay 18 is still kept energized, so the compressor 1 continue its operation. When the frost on the outdoor exchanger 4 has thawed by the defrosting operation and the discharge pressure is rised and reach the set pressure of a pressure switch 23, the contact of said switch 23 opens to break a circuit (not shown) extending into the printed circuit substrate 21 thereby reconverting the defrosting operation circuit into the heating operation circuit.

Further, the arrangement is such that the resistance values relating to the temperature obtained in the outdoor temperature sensing thermistor 16 and the outdoor air relative humidity sensing thermistor 17 are fed as input signals into circuits within the printed circuit substrate 21, so that solenoid valve coil 20 can be controlled by the afore-noted comparison and decision circuit thereby controlling the opening and closing of the solenoid valve 13.

Figure 4:
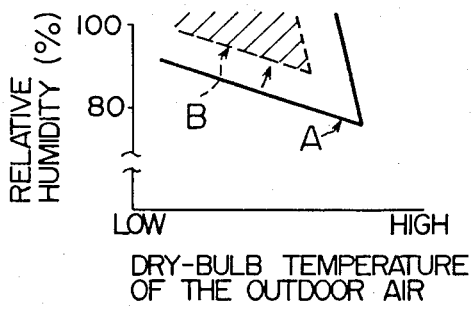
FIG. 4 is a diagram explaining the frosting zones in relation to outdoor air temperature and outdoor air relative humidity.

With respect to the relationship between the outdoor air temperature and the outdoor air relative humidity, it is shown, as seen in FIG. 4, that when the solenoid valve 13 opens and allows a part of the discharge gas to enter the outdoor heat exchanger 4, the frosting zone boundary line A tends to retreat to the dashed line B.

Now, in the following, the preferred embodiment will be explained with regard to its operation.

At the time of the cooling operation of the apparatus, the refrigerant, by switching the four-way valve 2 as shown by the arrow head of a dashed line, is allowed to flow, as is indicated by the arrow-headed dashed lines, starting from the compressor 1 and consecutively through the four-way valve 2, the outdoor heat exchanger 4, the second check valve 8, the capillary tube 6 for cooling and the indoor heat exchanger 3, and thence again through the four-way valve 2 to return to the compressor 1, thus the outdoor heat exchanger 4 working as a condenser while the indoor heat exchanger 3 working as an evaporator. As will be understood, the indoor heat exchanger 3 functions to cool the room cooling water, which is provided to serve the cooling purpose. During this cooling operation, the solenoid valve 13 is kept close.

Figure 5:
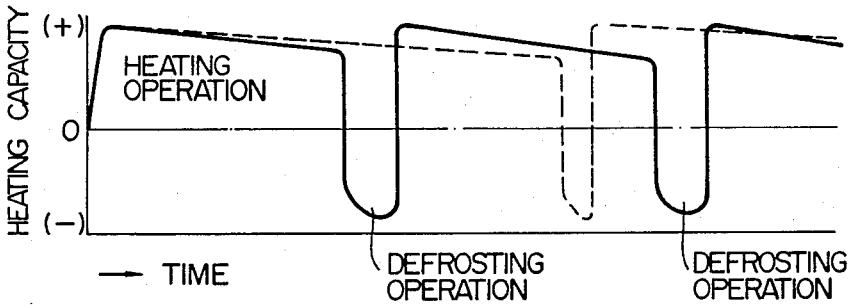
FIG. 5 is a diagram showing a change of the heating capacity relative to the lapse of time.

On the other hand, at the time of the heating operation of the apparatus, by switching the four-way valve 2 as indicated by the arrow-headed solid line, the refrigerant is allowed to flow, as shown by the arrow heads of the solid lines, starting from the compressor 1 and consecutively through the four-way valve 2, the indoor heat exchanger 3, the first check valve 7, the capillary tube 5 for heating and the outdoor heat exchanger 4, and thence again through the four-way valve 2 to return to the compressor 1. In this case, the indoor heat exchanger 3 works as a condenser while the outdoor heat exchanger 4 works as an evaporator. Thus, the indoor heat exchanger 3 functions to heat the room heating water, which is provided to serve the heating purpose. During this heating operation, the thermistors sense respectively the outdoor air temperature and the outdoor air relative humidity and, when the frosting zone on the outdoor heat exchanger 4 has reached its boundary line A shown in FIG. 4, the solenoid valve 13 is caused to open by the operation of the circuit (not shown) in the printed circuit substrate 21, whereby a part of the discharge gas from the compressor 1 is injected through the branch tube 10 and the capillary tubes 12 into the heat transfer tubes 9 of the outdoor heat exchanger 4, so that, during the heating operation, the evaporation temperature of the outdoor heat exchanger 4 may be caused to elevate to thereby restrict the frosting to the extent that the frosting zone retreats to that demarcated by the line B as seen in FIG. 4. As will be observed in FIG. 5, in a prior art operation, as the frosting advances as indicated by a solid line, the heating efficiency tends to deteriorate and in a rather short period of time the defrosting operation starts thus entering into its negative heating performance leading to a substantial reduction in its integrated heating capacity, whereas, in the preferred embodiment of the invention, the heating capacity can be maintained as indicated by a dashed line by a controlled frosting and also its intervals for defrosting operations can be substantially elongated, thereby enabling an improvement in its integrated heating capacity. According to the described construction, the defrosting operation is effected by the switching of the four-way valve 2 in the same way as the cooling operation. Thus, the refrigerant flows following the same route as that in the cooling operation and the frost which has collected on the outdoor heat exchanger 4 is caused to thaw by the gas discharged. More particularly, also at the time of the defrosting operation, the solenoid valve 13 is opened to inject a part of the discharge gas into the outdoor heat exchanger 4 additionally at the points 9*a* midway on the respective heat transfer tubes 9, so that an improved defrosting effect can be obtained due to the flowing of such discharge gas through the heavily frosted heat transfer tube portions, for it boosts the defrosting effect.

Figure 6:
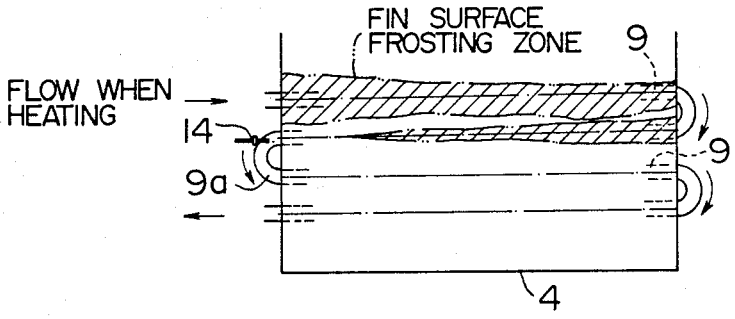
FIG. 6 is a diagram describing the conditions of the frosting on respective heat transfer tubes of the outdoor heat exchanger.

Turning now to FIG. 6 and considering the frosting conditions on the outdoor heat exchanger 4, it will be observed that since, at the time of the heating operation, the refrigerant flows into the heat transfer tubes 9 at their upper portions and goes down to their lower portions, a larger amount of the frost deposists as layers on the inflow side of each heat transfer tube 9, that is, on the upstream side of the flow passages at the heating, at the time of the defrosting operation, the discharge gas for defrosting is injected into the heat transfer tubes 9 at the points 9*a* midway, that is, just at the heavily frosted portions of the heat transfer tubes 9, so that the gas is capable of being effectively utilized for the defrosting purposes.

It is to be noted that although, in the preferred embodiment, the indoor heat exchanger 3 has been described as such which can cool and heat water available for both the cooling and heating purposes, the teachings according to the present invention can of course be applied to an arrangement wherein an air heat exchanger is put indoors instead of said indoor heat exchanger 3.

What is claimed is:

1. An air-cooled heat pump type refrigerating apparatus having a refrigerant circuit reversible into heating and cooling operation modes, comprising a series of elements connected successively by piping means which include a compressor, a four-way valve, an indoor heat exchanger, a capillary tube for cooling having second check valve connected in parallel therewith, a capillary tube for heating having first check valve connected in parallel therewith and an outdoor heat exchanger, said circuit, by shifting the four-way valve, being capable of providing the heating operation mode in which a communication route is established in the order through the compressor, the four-way valve, the indoor heat exchanger, the first check valve, the second capillary tube, the outdoor heat exchanger, the four-way valve and the compressor, and the cooling operation mode in which a communication route is established in the order through the compressor, the four-way valve, the outdoor heat exchanger, the second check valve, the first capillary tube, the indoor heat exchanger, the four-way valve and the compressor as well as a defrosting operation mode in which a communication route is established through the same route as that in that cooling operation mode, characterized in that a branch tube branching off from a discharge tube of the compressor is provided, said branch tube being provided midway thereon with a solenoid valve and having a plurality of capillary tubes connected to the other end of the branch tube through a distributor, and said capillary tubes are connected respectively to heat transfer tubes of the outdoor heat exchanger at points midway thereon, and said solenoid valve is arranged to effect during the heating operation the opening and closing thereof by means of a control circuit which operates to sense outdoor air temperature and outdoor air relative humidity.

2. An air-cooled heat pump type refrigerating apparatus as claimed in claim 1, wherein also at the time of the defrosting the solenoid valve is caused to open.

3. An air-cooled heat pump type refrigerating apparatus as claimed in claim 1, wherein the discharge gas which is injected into the heat transfer tubes of the outdoor heat exchanger at points midway thereon, at the time of the defrosting, is caused to flow through the passage adapted to function as the upstream passage at the time of the heating.

4. An air-cooled heat pump type refrigerating apparatus as claimed in claim 1, wherein the indoor heat exchanger is constituted of a heat exchanger which cools and heats water available for the room cooling and heating.

5. An air-cooled heat pump type refrigerating apparatus as claimed in claim 1, wherein the indoor heat exchanger is constituted of an air heat exchanger intended for the room cooling and heating.

* * * * *